US009982470B2

(12) United States Patent
Jaranson et al.

(10) Patent No.: US 9,982,470 B2
(45) Date of Patent: May 29, 2018

(54) SOFT CLOSE MECHANISM FOR A CLOSURE

(71) Applicant: Ford Global Technologies, LLC, Dearborn, MI (US)

(72) Inventors: John W. Jaranson, Dearborn, MI (US); Michael M. Azzouz, Livonia, MI (US); Jeffrey A. Wallace, Walled Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 886 days.

(21) Appl. No.: 13/673,000

(22) Filed: Nov. 9, 2012

(65) Prior Publication Data

US 2014/0130299 A1 May 15, 2014

(51) Int. Cl.

| | |
|---|---|
| ***E05F 3/20*** | (2006.01) |
| ***E05F 1/12*** | (2006.01) |
| ***E05F 5/02*** | (2006.01) |

(52) U.S. Cl.

CPC ..... *E05F 1/1215* (2013.01); *E05F 5/025* (2013.01); *Y10T 16/304* (2015.01)

(58) Field of Classification Search

CPC .... E05F 1/066; E05F 1/061; E05Y 2201/638; Y10T 16/5387

USPC ..... 16/49, 50, 54, 286, 290, 295, 303, 304, 16/315, 316; 3/49, 50, 54, 286, 290, 295, 3/303, 304, 315, 316

See application file for complete search history.

(56) References Cited

U.S. PATENT DOCUMENTS

| | | | | | |
|---|---|---|---|---|---|
| 1,200,538 | A | * | 10/1916 | Smith et al. | 16/303 |
| 1,556,204 | A | * | 10/1925 | Cohen | E05F 1/1223 16/50 |
| 1,907,625 | A | * | 5/1933 | Vogt | 70/100 |
| 2,164,358 | A | * | 7/1939 | Stannard | 16/54 |
| 2,497,425 | A | * | 2/1950 | Terry | 126/285 R |
| 2,981,560 | A | * | 4/1961 | Wehner | 292/207 |
| 3,203,718 | A | * | 8/1965 | Bishop | 292/62 |
| 3,501,932 | A | * | 3/1970 | Bishop | 70/90 |

(Continued)

FOREIGN PATENT DOCUMENTS

| | | | |
|---|---|---|---|
| CN | 101338782 | A | 1/2009 |
| CN | 101705775 | A | 5/2010 |

(Continued)

OTHER PUBLICATIONS

Ben Krasnow, "Retrofitting Ikea cabinet door dampers to old Ikea cabinets and non-Ikea cabinets," http://benkrasnow.blogspot.com/2010/09/retrofitting-ikea-cabinet-door-dampers.html, Sep. 28, 2010, 6 Pages.

(Continued)

*Primary Examiner* — Jason W San

(74) *Attorney, Agent, or Firm* — Jason Rogers; Brooks Kushman

(57) ABSTRACT

A soft close mechanism that may have a cam track housing, a damper housing, and a cam follower. The cam track housing may have first and second grooves. The damper housing may rotate with respect to the cam track housing. The cam follower may be disposed in the first groove when the damper housing is rotated in a first direction and may be disposed in the second groove when the damper housing is rotated in a second direction.

20 Claims, 6 Drawing Sheets

(56) References Cited

U.S. PATENT DOCUMENTS

| | | | | | |
|---|---|---|---|---|---|
| 3,626,547 | A * | 12/1971 | Werner | E05D 11/04 | 16/275 |
| 3,921,422 | A * | 11/1975 | Walters | E05D 11/1007 | 70/104 |
| 4,485,522 | A * | 12/1984 | Chen | 16/54 | |
| 4,583,775 | A * | 4/1986 | Bisbing | 292/64 | |
| 4,788,746 | A * | 12/1988 | Idler | 16/297 | |
| 5,169,221 | A * | 12/1992 | Wheeler | H05K 7/16 | 16/358 |
| 5,367,745 | A * | 11/1994 | Roloff | A47K 3/36 | 16/312 |
| 5,738,389 | A * | 4/1998 | Marks | 292/63 | |
| 6,205,619 | B1 * | 3/2001 | Jang | 16/352 | |
| 6,647,593 | B2 * | 11/2003 | Iguchi et al. | 16/386 | |
| 6,928,699 | B2 * | 8/2005 | Sawa | 16/312 | |
| 7,155,779 | B2 * | 1/2007 | Watkins | 16/316 | |
| 7,213,301 | B2 * | 5/2007 | Sakai et al. | 16/303 | |
| 7,654,027 | B1 * | 2/2010 | Grover | F16B 21/165 | 24/573.11 |
| 7,695,032 | B2 * | 4/2010 | Bodily | 292/337 | |
| 7,810,214 | B2 * | 10/2010 | Feng et al. | 16/348 | |
| 7,823,254 | B2 * | 11/2010 | Lin | 16/337 | |
| 9,376,845 | B2 * | 6/2016 | Sawaguchi | E05D 3/022 | |
| 9,458,890 | B1 * | 10/2016 | Fu | F16D 1/04 | |
| 9,487,988 | B2 * | 11/2016 | Bacchetti | E05F 1/1223 | |
| 2006/0096064 | A1 * | 5/2006 | Ma et al. | 16/303 | |
| 2008/0155784 | A1 * | 7/2008 | Hsu et al. | 16/303 | |
| 2008/0242380 | A1 * | 10/2008 | Kajihara et al. | 455/575.4 | |
| 2010/0050385 | A1 * | 3/2010 | Zhang et al. | 16/303 | |
| 2011/0072618 | A1 * | 3/2011 | Chen | 16/303 | |
| 2011/0191982 | A1 * | 8/2011 | Vallance | 16/82 | |
| 2011/0209836 | A1 * | 9/2011 | Yu | E06B 9/322 | 160/305 |
| 2011/0277274 | A1 * | 11/2011 | Duan et al. | 16/304 | |
| 2011/0286160 | A1 * | 11/2011 | Duan et al. | 361/679.01 | |
| 2012/0140388 | A1 * | 6/2012 | Ahn | 361/679.01 | |
| 2015/0204128 | A1 * | 7/2015 | Bacchetti | E05F 1/1223 | 16/53 |
| 2015/0233164 | A1 * | 8/2015 | Bacchetti | E05F 3/20 | 16/54 |
| 2016/0123054 | A1 * | 5/2016 | Senatori | E05D 3/12 | 361/679.27 |

FOREIGN PATENT DOCUMENTS

| | | | |
|---|---|---|---|
| CN | 201605927 | U | 10/2010 |
| CN | 202347989 | U | 7/2012 |
| DE | 3642442 | C1 | 8/1987 |
| JP | 8312237 | A | 11/1996 |
| KR | 100776627 | B1 | 11/2007 |
| WO | 2006025663 | A1 | 3/2006 |

OTHER PUBLICATIONS

Chinese Patent and Trademark Office, First Chinese Office Action for the corresponding Chinese Patent Application No. 201310556806.4 dated Apr. 1, 2016.

* cited by examiner

SOFT CLOSE MECHANISM FOR A CLOSURE

TECHNICAL FIELD

This application relates to a soft close mechanism that may be provided with a closure such as a door.

BACKGROUND

An automatic closing door mechanism is disclosed in U.S. Pat. No. 6,928,699.

SUMMARY

In at least one embodiment, a soft close mechanism is provided. The soft close mechanism may include a cam track housing, a damper housing, and a cam follower. The cam track housing may have first and second grooves. The damper housing may be rotatably disposed on the cam track housing and may have a slot. The cam follower may extend through the slot. The cam follower may be disposed in the first groove when the damper housing is rotated in a first direction and may be disposed in the second groove when the damper housing is rotated in a second direction.

In at least one embodiment, a soft close mechanism is provided. The soft close mechanism may include a cam track housing, a damper housing, and a cam follower. The cam track housing may have first and second grooves that intersect at two locations. The damper housing may be configured to rotate about an axis with respect to the cam track housing. The cam follower may move from the first groove to the second groove when the damper housing is rotated in a first direction.

In at least one embodiment, a soft close mechanism is provided. The soft close mechanism may include a cam track housing, a damper housing, a cam follower cup, a set of cam followers, a cam follower spring, and a spring. The cam track housing may have a set of cam tracks. Each member of the set of cam tracks may include first and second grooves. The damper housing may be disposed proximate the cam track housing and may rotate about an axis. The cam follower cup may be moveably disposed in the damper housing. Each member of the set of cam followers may extend through the cam follower cup and may be received in a member of the set of cam tracks. The cam follower spring may bias each member of the set of cam followers away from the axis. The spring may bias the cam follower cup toward a first surface of the damper housing that may be disposed opposite the cam track housing.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
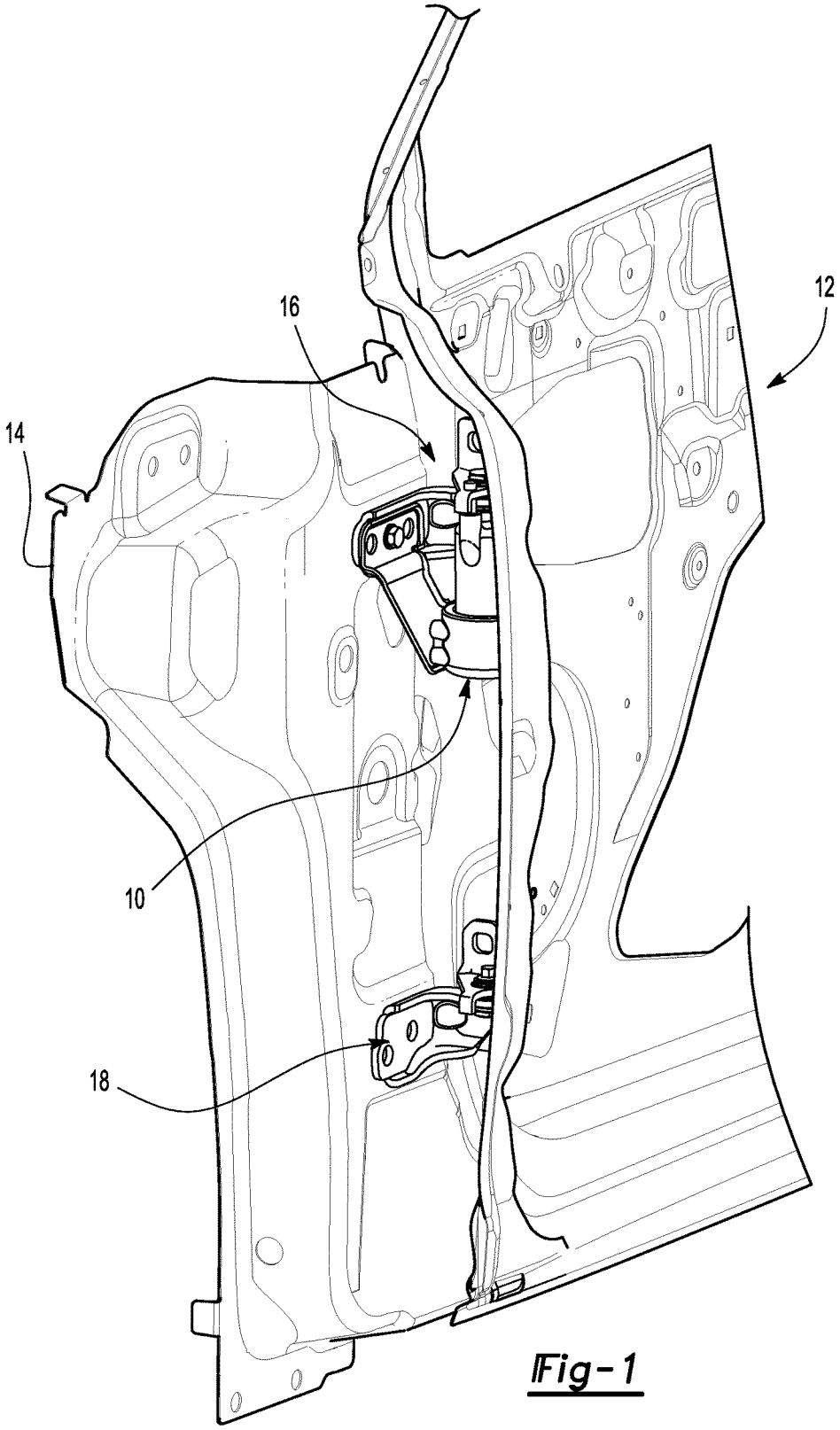
FIG. 1 is a perspective view of a soft close mechanism coupled to a closure and a support structure.

Referring to FIG. 1, a soft close mechanism 10 is shown coupled to a closure 12 and a support structure 14. The soft close mechanism 10 may be provided to control movement of the closure 12. The soft close mechanism 10 may be used in vehicular and non-vehicular applications. In a vehicle context, the closure 12 may be a door, hatchback, hood, lid, tailgate, trunk, or the like. In the embodiment shown in FIG. 1, the closure 12 is depicted as a door and the support structure 14 is depicted as a vehicle body structure, such as a side pillar or door frame. The closure 12 may be mounted to the support structure 14 with at least one hinge assembly. In FIG. 1, the closure 12 is mounted to the support structure 14 with a first hinge assembly 16 and a second hinge assembly 18.

Figure 2:
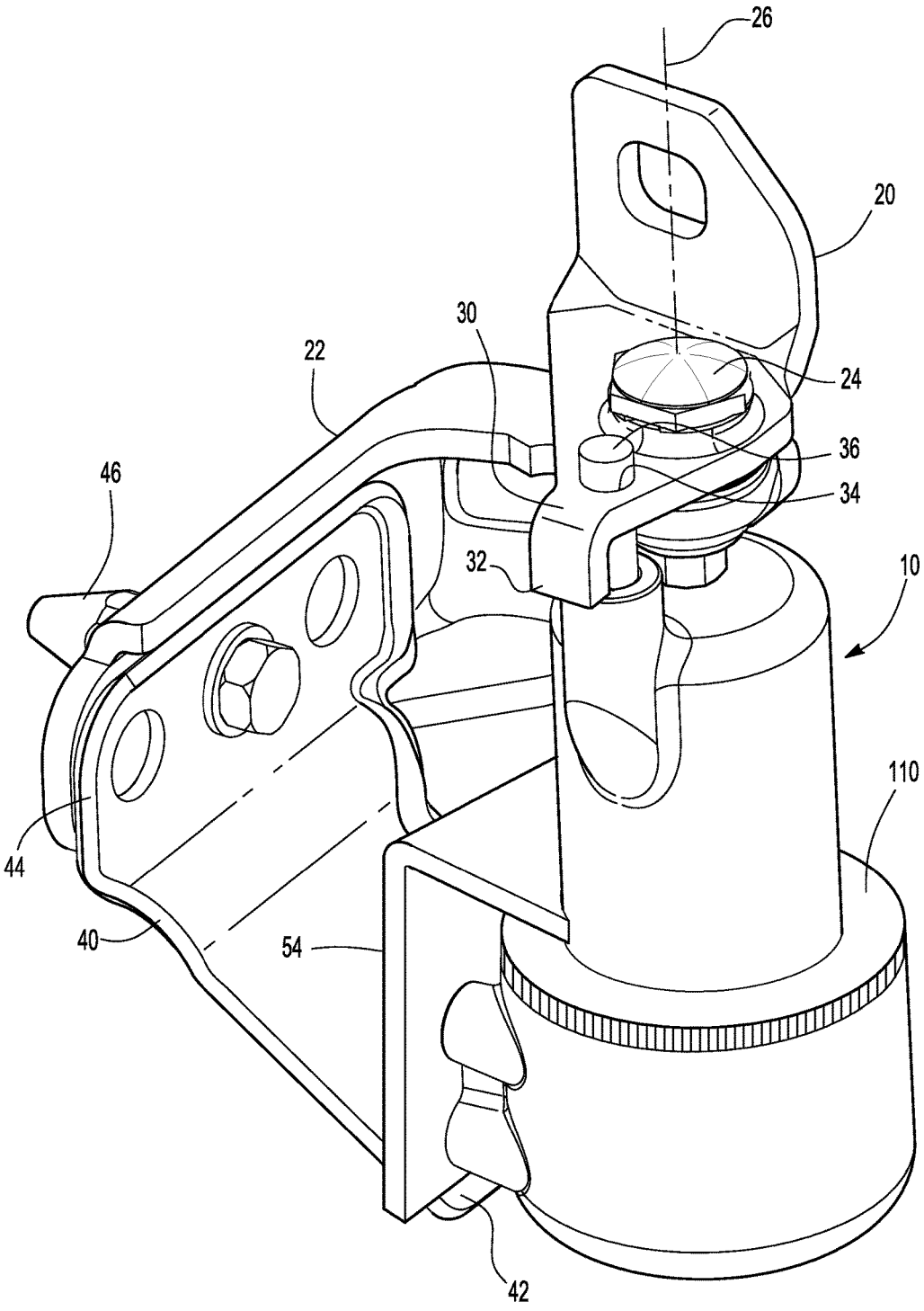
FIG. 2 is a perspective view of the soft close mechanism and a hinge assembly.

Referring to FIG. 2, the soft close mechanism 10 and the first hinge assembly 16 are shown in more detail. The first hinge assembly 16 may include a first hinge portion 20 and a second hinge portion 22. The first hinge portion 20 may be mounted on the closure 12. The second hinge portion may be mounted on the support structure 14. The first and second hinge portions 20, 22 may be mounted in any suitable manner, such as with one or more fasteners. A hinge pin 24 may pivotally couple the first hinge portion 20 to the second hinge portion 22. As such, the closure 12 may rotate about an axis of rotation 26 that extends through the hinge pin 24. The hinge pin 24 may be spaced apart from the soft close mechanism 10 in one or more embodiments. In the embodiment shown, the soft close mechanism 10 is disposed below the hinge pin 24.

The first hinge portion 20 may include an arm 30 that may be offset from the axis of rotation 26. The arm 30 may include a hook portion 32 and a hole 34.

The hook portion 32 may be disposed at an end of the arm 30. The hook portion 32 may extend toward the soft close mechanism 10 and may act as a stop that may engage the second hinge portion 22 or another component to limit the range of travel of the closure 12.

The hole 34 may be disposed between the hook portion 32 and the hinge pin 24. The hole 34 may receive a pin 36 that couples the soft close mechanism 10 to the first hinge portion 20. The pin 36 may be offset from the axis of rotation 26.

A mounting bracket 40 may be provided to facilitate mounting of the soft close mechanism 10. The mounting bracket 40, if provided, may be fixedly coupled to the soft close mechanism 10 and the support structure 14. In the embodiment shown, the mounting bracket 40 includes a first end 42 and a second end 44. The first end 42 may be coupled to the soft close mechanism 10 in any suitable manner, such as with one or more fasteners. The second end 44 may be disposed opposite the first end 42. The second end 44 may be fixedly coupled to the support structure 14 in any suitable manner, such as with one or more fasteners. In at least one embodiment, the second end 44 may engage the second hinge portion 22. In addition, one or more fasteners may extend through corresponding holes in the mounting bracket 40 and the second hinge portion 22 to couple the mounting bracket 40 and a second hinge portion 22 to the support structure 14 in one or more embodiments. A locator 46 may be provided that extends through corresponding holes in the mounting bracket 40 and a second hinge portion 22. The locator 46 may couple the mounting bracket 40 and the second hinge portion 22 prior to assembly to the support structure 14.

Figure 3:
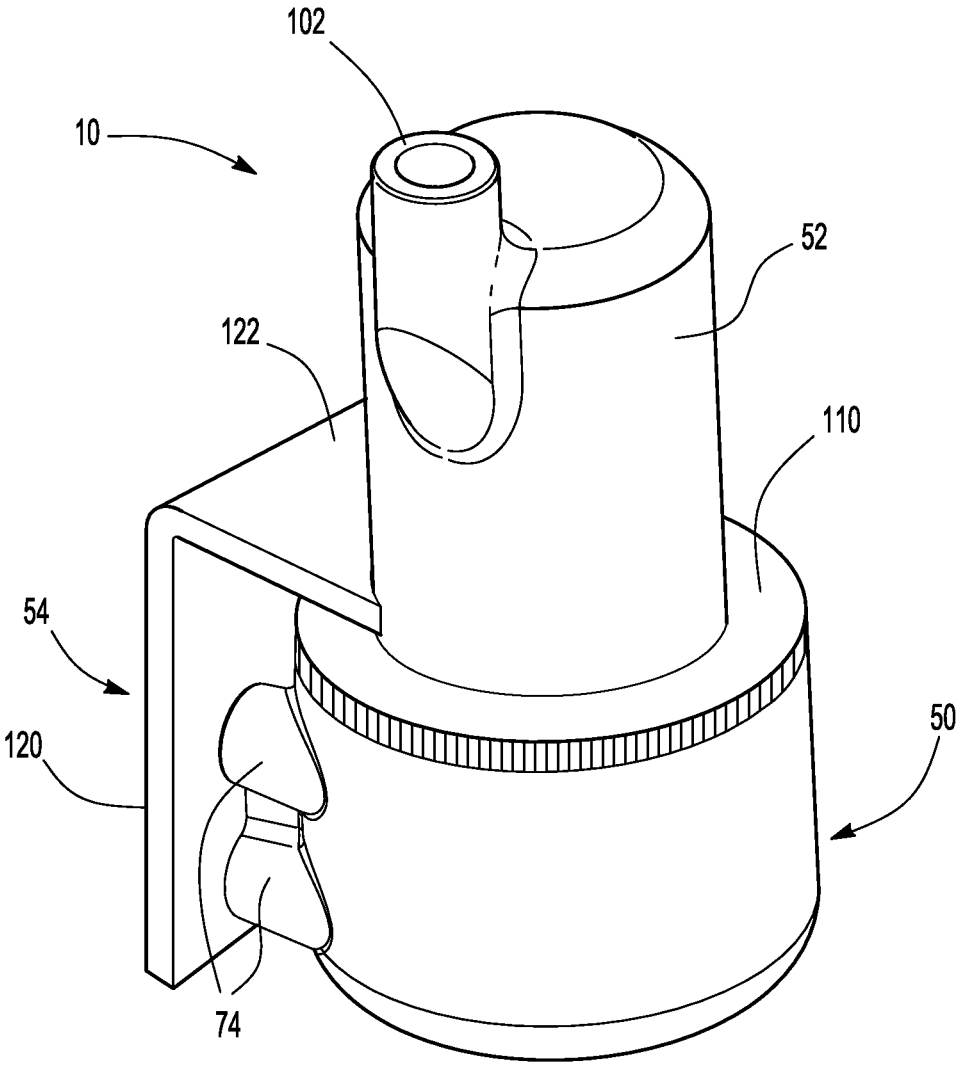
FIG. 3 is a perspective view of the soft close mechanism.
Figure 4:
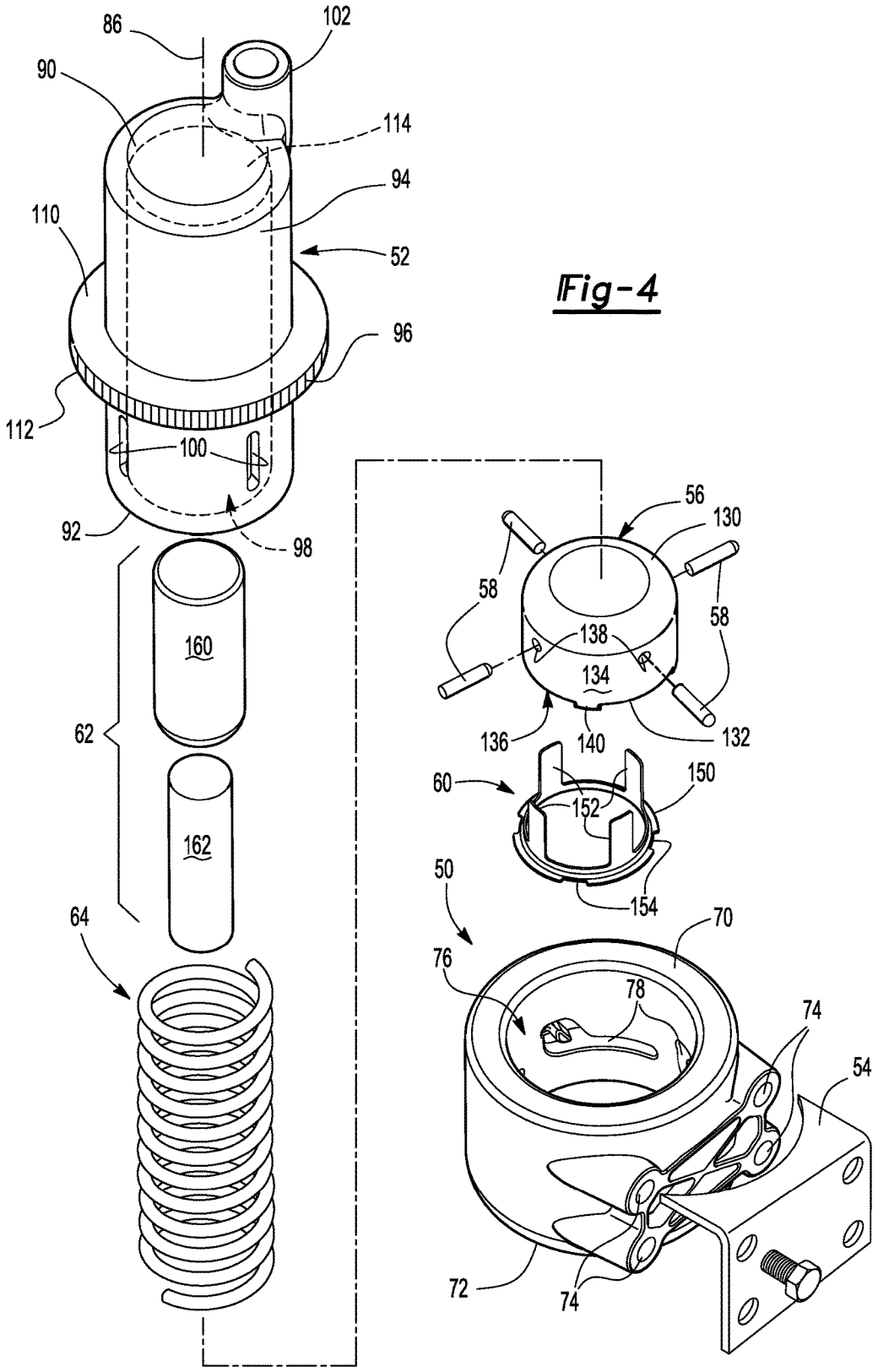
FIG. 4 is an exploded view of the soft close mechanism.
Figure 5:
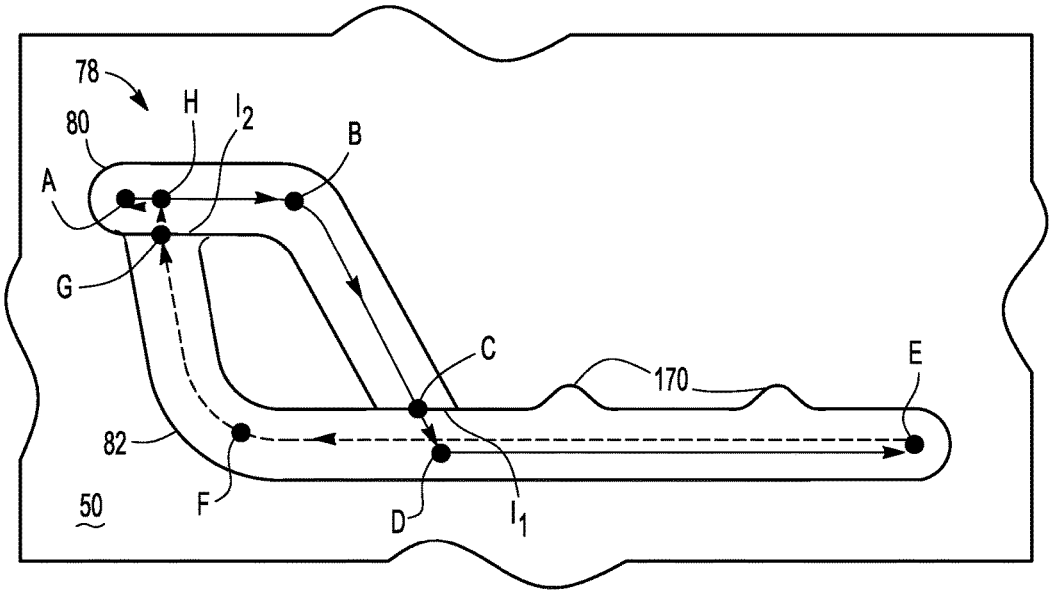
FIG. 5 is a schematic representation of a cam track having first and second grooves that may be provided with the soft close mechanism.
Figure 6:
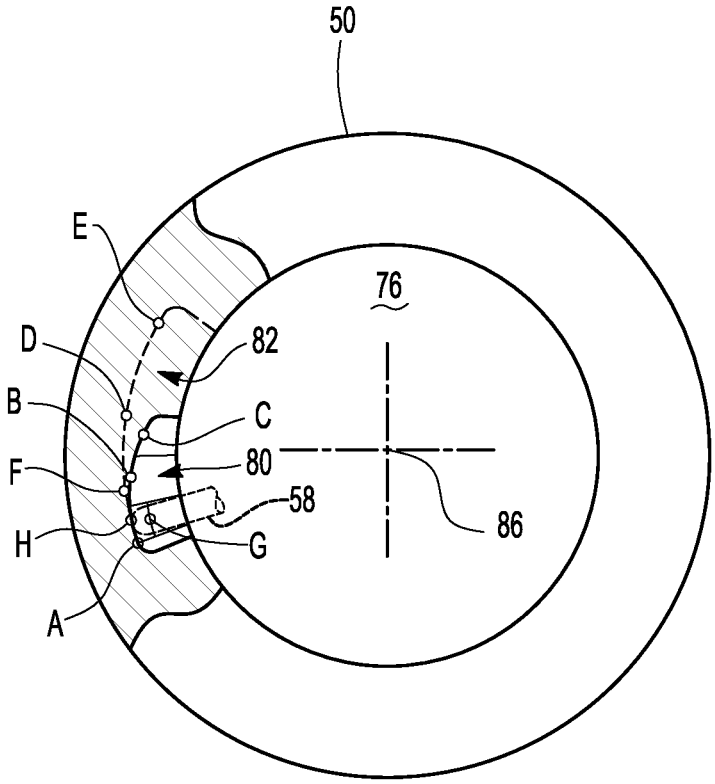
FIG. 6 is a fragmentary top section view that shows depths of first and second grooves that may be provided with the soft close mechanism.

Referring to FIGS. 3-5, the soft close mechanism 10 is shown in more detail. The soft close mechanism 10 may store energy when the closure 12 is opened and release energy when the closure 12 is closed to help fully close the closure 12 while maintaining desirable closure actuation efforts. In at least one embodiment, the soft close mechanism 10 may include a cam track housing 50, a damper housing 52, a flange bracket 54, a cam follower cup 56, at least one cam follower 58, a cam follower spring 60, a damper 62, and a spring 64.

The cam track housing 50 may facilitate mounting and may receive various components of the soft close mechanism 10. In at least one embodiment, the cam track housing 50 may include a first surface 70, a second surface 72, one or more mounting features 74, a cavity 76, and one or more cam tracks 78.

The first surface 70 may be disposed at an end of the cam track housing 50. The second surface 72 may be disposed opposite the first surface 70.

One or more mounting features 74 may be provided on the cam track housing 50 to facilitate mounting of the cam track housing 50 to another component. In the embodiment shown, four mounting features 74 are provided that extend from the cam track housing 50 and are located between the first surface 70 and the second surface 72. Each mounting feature 74 may receive a fastener that may couple the cam track housing 50 to the support structure 14 and/or mounting bracket 40.

A cavity 76 may be provided in the cam track housing 50. The cavity 76 may extend from the first surface 70 toward the second surface 72.

One or more cam tracks 78 may be provided in the cavity 76. In the embodiment shown, a set of four cam tracks 78 is provided, although a greater or lesser number of cam tracks 78 may be employed in various embodiments. The cam tracks 78 may be spaced apart from each other and may be disposed between the first surface 70 and the second surface 72. As is best shown in FIG. 5, each cam track 78 may include a first groove 80 and a second groove 82. The first and second grooves 80, 82 may intersect and may cooperate to define paths that guide movement of a cam follower 58 when the closure 12 travels between an open position and a closed position as will be discussed in more detail below.

The damper housing 52 may be rotatably disposed on the cam track housing 50. More specifically, the damper housing 52 may be configured to rotate about an axis 86 and with respect to the cam track housing 50. The axis 86 may or may not be coaxially disposed with the axis of rotation 26 depending on the position of the soft close mechanism 10. In at least one embodiment, the damper housing 52 may include a first surface 90, a second surface 92, a third surface 94, a flange 96, a damper housing cavity 98, one or more slots 100, and a mounting boss 102.

The first surface 90 may be disposed at an end of the damper housing 52. The second surface 92 may be disposed opposite the first surface 90. The second surface 92 may be disposed in the cavity 76 of the cam track housing 50. The third surface 94 may be an exterior surface of the damper housing 52. The third surface 94 may be an outside circumference of the damper housing 52.

The flange 96 may be disposed between the first surface 90 and the second surface 92. The flange 96 may extend outwardly from the third surface 94 in a ring-like manner. The flange 96 may include a first flange surface 110 and a second flange surface 112. The first flange surface 110 may engage the flange bracket 54. The second flange surface 112 may be disposed opposite the first flange surface 110. The second flange surface 112 may face toward and may engage the first surface 70 of the cam track housing 50.

The damper housing cavity 98 may be disposed in the damper housing 52. The damper housing cavity 98 may extend from the second surface 92 toward the first surface 90 and may terminate at an end surface 114 that may be disposed inside the damper housing 52.

One or more slots 100 may extend through the damper housing 52. More specifically, a slot 100 may extend from the third surface 94 to the damper housing cavity 98. In the embodiment shown, a set of four slots 100 are provided, although a greater or lesser number of slots may be employed in various embodiments. The slots 100 may be spaced apart from each other and may be located between the second surface 92 and the flange 96. Each slot 100 may be elongated in a direction that extends substantially parallel to the axis 86. The slots 100 may facilitate axial movement of the cam follower cup 56 as will be described in more detail below.

The mounting boss 102 may be provided on the exterior of the damper housing 52. In the embodiment shown, the mounting boss 102 is offset from the axis 86 and generally extends from the first and third surfaces 90, 94. The mounting boss 102 may engage the pin 36 to couple the damper housing 52 to the first hinge portion 20. As such, the damper housing 52 may rotate with the closure 12.

Referring to FIGS. 2 and 3, the flange bracket 54 may help couple the cam track housing 50 and the damper housing 52 while permitting the damper housing 52 to rotate relative to the cam track housing 50. In at least one embodiment, the flange bracket 54 may include a first portion 120 and a second portion 122. The first portion 120 may engage and/or may be fixedly positioned relative to the cam track housing 50. For example, the first portion 120 may engage one or more mounting features 74 on the cam track housing 50 and may have one or more holes that may receive fasteners that are used to mount the cam track housing 50. The second portion 122 may extend from the first portion 120. The second portion 122 may extend toward the third surface 94 of the damper housing 52 and may be disposed proximate or may engage the first flange surface 110. As such, the flange bracket 54 may inhibit axial movement or disengagement of the damper housing 52 from the cam track housing 50.

Referring again to FIG. 4, the cam follower cup 56 may be moveably disposed in the cam track housing 50 and/or damper housing 52. More specifically, the cam follower cup 56 may move along the axis 86 within the cavity 76 and/or damper housing cavity 98. The cam follower cup 56 may include a first surface 130, a second surface 132, a third surface 134, a cam follower cup cavity 136, and one or more holes 138.

The first surface 130 may be disposed in the damper housing cavity 98 and may face toward the end surface 114 of the damper housing 52.

The second surface 132 may be disposed opposite the first surface 130. The second surface 132 may be disposed in the cavity 76 of the cam follower cup 56. One or more tabs 140 may extend from the second surface 132 and away from the first surface 130. The tabs 140 may facilitate positioning of the cam follower spring 60.

The third surface 134 may extend from the first surface 130 to the second surface 132. In the embodiment shown, the third surface 134 is configured as an outside circumferential surface.

The cam follower cup cavity 136 may extend from the second surface 132 to or toward the first surface 130.

One or more holes 138 may extend from the third surface 134 to the cam follower cup cavity 136. In the embodiment shown, a set of four holes 138 are provided, although a greater or lesser number of holes may be employed in various embodiments. The holes 138 may be offset from each other and may be aligned with a corresponding slot 100 on the damper housing 52.

One or more cam followers 58 may be provided to couple and guide movement of the cam follower cup 56 with respect to the cam track housing 50. In the embodiment shown, a set of four cam followers 58 are provided, although a greater or lesser number of cam followers 58 may be employed in various embodiments. Each cam follower 58 may be generally configured as a pin and may have a rounded or spherical end that is received in a corresponding cam track 78. More specifically, each cam follower 58 may extend through a hole 138 and a corresponding slot 100 and into the first and/or second grooves 80, 82 of the cam track 78. Each cam follower 58 may move radially with respect to the axis 86 as will be described in more detail below.

The cam follower spring 60 may exert a biasing force on one or more cam followers 58. More specifically, the cam follower spring 60 may bias a cam follower 58 away from the axis 86. The cam follower spring 60 may be disposed in the cam follower cup cavity 136. In the embodiment shown, the cam follower spring 60 includes a ring portion 150 and a plurality of spring portions 152.

The ring portion 150 may engage the second surface 132 of the cam follower cup 56. The ring portion 150 may include one or more notches 154 that receive a tab 140 that extends from the cam follower cup 56. As such, the notches 154 may cooperate with the tabs 140 to align and/or inhibit rotation of the cam follower spring 60.

A spring portion 152 may extend from the ring portion 150 toward the first surface 130. In the embodiment shown, a set of four spring portions 152 are provided, although a greater or lesser number may be provided in various embodiments. The spring portions 152 may be spaced apart from each other. Each spring portion 152 may be disposed between a cam follower 58 and the axis 86. Each spring portion 152 may engage an end of the cam follower 58 and may bias the cam follower 58 away from the axis 86.

The damper 62 may be disposed in the damper housing cavity 98. The damper 62 may act as a shock absorber and dampen axial movement of the cam follower cup 56. The damper 62 may include a first portion 160 and a second portion 162. The first portion 160 may engage and may be fixedly disposed on the end surface 114 of the damper housing cavity 98. The second portion 162 may be received in the first portion 160 and may engage or may be integrally formed with the first surface 130 of the cam follower cup 56. In addition, the damper 62 may be disposed outside of the spring 64 and/or outside of the cam track housing 50 and/or damper housing 52 in one or more embodiments.

The spring 64 may bias the cam follower cup 56 toward the end surface 114 of the damper housing 52. In at least one embodiment, the spring 64 may be disposed in the damper housing cavity 98. In addition, the spring 64 may be disposed around the damper 62 in one or more embodiments. The spring 64 may include a first end and a second end. The first end may be fixedly coupled to the damper housing 52. The second end may be disposed opposite the first end and may be fixedly coupled to the cam follower cup 56. The spring 64 may also be provided in different locations. For example, the spring 64 may be positioned in the cam track housing 50 or under the cam follower cup 56, such that the spring 64 compresses the cam follower cup 56 toward the damper housing 52.

Referring to FIG. 5, operation of the soft close mechanism 10 will now be described in more detail. In FIG. 5, a first groove 80 and a second groove 82 are shown. The first and second grooves 80, 82 may be recessed into the cam follower cup 56 such that the groove depth or distance from the axis 86 varies at different points or locations along the first and second grooves 80, 82. The different groove depths help ensure that the cam follower 58 follows different paths when the closure 12 is opened and closed.

The first groove 80 may extend from a first endpoint, designated point A, to a second endpoint, designated point C. Point A may correspond to the location of the cam follower 58 when the closure 12 is in the closed position. The depth of the first groove 80 at point A may be greater than the depth at point C. For example, the depth at point A may be 6 mm in the depth at point C may be 3 mm. As such, the depth of the first groove 80 may slope upward between points A and C. Alternatively, the depth of the first groove 80 may slope upward from an intermediate location between points A and C, such as point B. The slope may change at a constant rate in one or more embodiments.

The second groove 82 may extend from a first endpoint, designated point E, to a second endpoint, designated point G. Point E may correspond to the location of the cam follower 58 when the closure is in the open position. The depth of the second groove 82 may also vary at different locations. For example, the second groove 82 may have a constant depth from point E to point F, such as 6 mm. The depth at point F may be greater than the depth at point G. For example, the depth at point F may be 6 mm and the depth at point G may be 3 mm. As such, the depth of the second groove 82 may slope upward from point F to point G. The slope may change at a constant rate in one or more embodiments.

Movement of the cam follower 58 when the closure 12 is opened and closed will now be described in more detail and is represented by following the solid arrowed line in FIG. 5.

Starting at point A, the closure 12 is in the closed position. As the closure 12 is pivoted about the axis of rotation 26, the damper housing 52 rotates about the axis 86 and with respect to the cam track housing 50. Rotation of the damper housing 52 causes the cam follower cup 56 to rotate with the damper housing 52 due to the interaction with the cam followers 58. Rotation of the cam follower cup 56 moves the cam follower 58 from point A toward point C. The cam follower 58 may be inhibited from moving into the second groove 82 or toward point G due to the greater depth of the first groove 80 between points A and B.

As the cam follower 58 moves from point A toward point C, the change in depth of the first groove 80 overcomes the biasing force of the cam follower spring 60 and actuates the cam follower 58 toward the axis 86. In addition, as the cam follower 58 moves from point B to point C, the cam follower 58 and cam follower cup 56 may move in axially or along the axis 86 such that the cam follower cup 56 is retracted into the cavity 76, or moves downwardly from the perspective shown in FIGS. 3 and 5.

Between points C and D, the cam follower 58 moves from the first groove 80 to the second groove 82. The first intersection of the first groove 80 and second groove 82 is designated $I_1$. At $I_1$, the second groove 82 is deeper than the first groove 80. For example, the depth at point C may be 3 mm while the depth at point D may be 6 mm. As such, the cam follower 58 may move away from the axis 86 under the biasing force of the cam follower spring 60 when the cam follower 58 moves across the first intersection $I_1$ from point C to point D. In addition, the cam follower cup 56 may continue to move axially from point C to point D.

The axial movement of the cam follower cup 56 from point B to point D stretches the spring 64, thereby causing potential energy to be stored in the spring 64.

Between point D and point E, the second groove 82 may have a constant depth. As such, the cam follower cup 56 and cam follower 58 may rotate about the axis 86, but the cam follower 58 may not move axially and/or radially. At point E the closure 12 is in the open position.

Movement of the closure 12 from the open position to the closed position will now be described in more detail and is represented by following the dashed arrowed line in FIG. 5.

Starting at point E, the door is in the open position. The cam follower 58 moves from point E to point F as the closure 12 is rotated about the axis of rotation 26 toward the closed position. Between point E and point F the second groove 82 may have a constant depth. As such, the cam follower cup 56 and cam follower 58 may rotate about the axis 86, but the cam follower 58 may not move axially and/or radially. Moreover, the cam follower 58 may be inhibited from moving across the first intersection $I_1$ and into the first groove 80 or toward point C due to the greater depth of the second groove 82 at point D.

From point F to point G, the depth of second groove 82 may decrease. As such, the cam follower 58 may move toward the axis 86 from point F to point G. In addition, the cam follower 58 and cam follower cup 56 may move axially between points F and G such that the cam follower cup 56 moves away from the cavity 76 and toward the end surface 114 of the damper housing 52, or upwardly from the perspective shown in FIGS. 3 and 5.

Between points G and H, the cam follower 58 may move from the second groove 82 into the first groove 80. The second intersection of the second groove 82 and first groove 80 is designated $I_2$. At $I_2$, the first groove 80 is deeper than the second groove 82. For example, the depth at point G may be 3 mm while the depth at point H may be 6 mm. As such, the cam follower 58 moves away from the axis 86 under the biasing force of the cam follower spring 60 when the cam follower 58 moves across the second intersection $I_2$ from point G to point H. In addition, the cam follower cup 56 continues to move in an axially from point G to point H. Point A may be rotationally offset from point H. As such, the cam follower 58 may be received in a notch at point A when the closure 12 reaches the closed position.

The axial movement of the cam follower cup 56 from point F to point H may allow the length of the spring 64 to decrease, thereby allowing potential energy to be released from the spring 64. The release of potential energy may occur over a short rotational distance when the closure 12 is nearing the closed position. Moreover, the release of potential energy may occur over a shorter rotational distance of the closure 12 than the rotational distance over which energy was stored in the spring 64. For example, rotational energy may be stored over a greater closure swing distance, such as 20 to 22° of closure swing from point B to point D and may be released over a shorter distance, such as the last 2 to 3° of closure swing from point F to point H, thereby effectively multiplying the effort exerted on the closure 12 by approximately 5 to 8 times.

Optionally, one or more detents 170 may be provided in the first and/or second grooves 80, 82. The detents 170 may be configured as indentations that receive the cam follower 58 to hold the closure 12 in a predetermined rotational location. The detents 170 may be provided in various configurations. For example, one or more detents 170 may be located along a top surface of a second groove 82 as is shown in phantom in FIG. 5. In such a configuration, a cam follower 58 may be biased into a detent 170 under the biasing force of the spring 64. Alternatively, one or more detents 170 may extend radially from the axis 86. A radial indentation may extend further from the axis 86 than adjacent regions of a groove 80, 82. For example, a radial indentation may have a depth of 9 mm in one or more embodiments.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A soft close mechanism comprising:

a cam track housing having a first groove and a second groove that intersect each other at two locations, wherein the first groove has first and second endpoints, wherein the first endpoint is disposed further from an axis of the cam track housing than the second endpoint;

a damper housing rotatably disposed on the cam track housing and having a slot, the damper housing being configured to rotate about the axis;

a damper disposed in the damper housing; and a cam follower extending through the slot that is in the first groove when the damper housing rotates in a first direction, and in the second groove when the damper housing rotates in a second direction.

2. The soft close mechanism of claim 1 wherein the cam track housing includes a cavity and wherein the first and second grooves are disposed in the cavity.

3. The soft close mechanism of claim 2 wherein the damper housing extends into the cavity such that the slot is disposed in the cavity.

4. The soft close mechanism of claim 1 wherein the two locations include a first location disposed between the first and second endpoints of the first groove and a second location disposed between first and second endpoints of the second groove.

5. The soft close mechanism of claim 1 wherein the cam follower moves from the second groove to the first groove when the damper housing is rotated in the second direction that is opposite the first direction.

6. The soft close mechanism of claim 1 wherein the cam follower extends further from the axis when the cam follower moves from the first groove into the second groove.

7. The soft close mechanism of claim 1 wherein the second groove has first and second endpoints, wherein the first endpoint of the second groove is disposed further from the axis than the second endpoint of the second groove.

8. The soft close mechanism of claim 1 wherein the cam follower extends further from the axis when the cam follower moves from the second groove into the first groove.

9. A soft close mechanism comprising:

a cam track housing having a first groove that intersects a second groove at two locations and does not extend through the cam track housing;

a damper and a spring extending from a cam follower cup, that are disposed in a damper housing, rotatably disposed on the cam track housing; and a cam follower that moves from the first groove to the second groove when the damper housing is rotated.

10. The soft close mechanism of claim 9 wherein the cam follower moves from the second groove to the first groove when the damper housing is rotated in a second direction that is opposite a first direction.

11. The soft close mechanism of claim 9 wherein the cam track housing further comprises a cavity and wherein the damper housing is received in the cavity.

12. The soft close mechanism of claim 9 wherein the damper housing includes a damper housing cavity and wherein the cam follower cup is disposed in the damper housing cavity, the cam follower cup having a hole that receives the cam follower.

13. The soft close mechanism of claim 12 further comprising a cam follower spring that is disposed in the cam follower cup and that biases the cam follower away from an axis of the cam track housing.

14. The soft close mechanism of claim 13 wherein the damper housing includes a slot and wherein the cam follower extends through the slot such that the cam follower cup moves along the axis when the damper housing is rotated about the axis.

15. The soft close mechanism of claim 12 wherein the damper extends from the cam follower cup to an end surface of the damper housing cavity.

16. The soft close mechanism of claim 15 wherein the spring biases the cam follower cup toward the end surface.

17. The soft close mechanism of claim 9 wherein the spring is disposed around the damper.

18. A soft close mechanism comprising:

a cam track housing having a set of cam tracks, wherein each member of the set of cam tracks includes a first groove that intersects a second groove at two locations and that do not extend through the cam track housing;

a damper disposed in a damper housing, the damper housing being disposed on the cam track housing and configured to rotate about an axis of the cam track housing;

a cam follower cup that is moveably disposed in the damper housing;

a set of cam followers, wherein each member of the set of cam followers extends through the cam follower cup and is received in a different member of the set of cam tracks;

a cam follower spring that biases each member of the set of cam followers away from the axis; and a spring that biases the cam follower cup toward a first surface of the damper housing disposed opposite the cam track housing.

19. The soft close mechanism of claim 18 wherein the damper housing is coupled to a closure and the cam track housing is coupled to a support structure.

20. The soft close mechanism of claim 19 wherein the damper housing includes a mounting boss that is offset from the axis, wherein the mounting boss facilitates coupling to the closure.

* * * * *